United States Patent [19]

Nishikawa et al.

[11] Patent Number: 4,782,998

[45] Date of Patent: Nov. 8, 1988

[54] METHOD AND APPARATUS FOR PRESS-CUTTING VARIOUS PATTERNS

[75] Inventors: Takehiko Nishikawa; Yasuo Ito; Yoshiyuki Hisamatsu; Naoki Tani, all of Aichi, Japan

[73] Assignee: Kabushiki Kaisha Tokai Rika Denki Seisakusho, Japan

[21] Appl. No.: 875,335

[22] Filed: Jun. 17, 1986

[30] Foreign Application Priority Data

Jun. 17, 1985 [JP] Japan ..... 60-131310

[51] Int. Cl.[4] ..... B21D 28/26

[52] U.S. Cl. ..... 234/1; 234/97; 234/98; 83/13; 83/687; 83/691

[58] Field of Search ..... 234/1, 97, 98; 83/13, 83/687, 691, 131

[56] References Cited

U.S. PATENT DOCUMENTS

| | | | |
|---|---|---|---|
| 1,313,699 | 8/1919 | Kavanagh | 234/98 X |
| 3,175,484 | 3/1965 | Bone | 234/97 X |
| 3,392,913 | 7/1968 | Neilsen | 234/98 |

*Primary Examiner*—Donald R. Schran

*Attorney, Agent, or Firm*—Finnegan, Henderson, Farabow, Garrett and Dunner

[57] ABSTRACT

A method and apparatus for press-cutting selected patterns in a workpiece. The apparatus includes a plurality of dies and at least one punch element associated with each die. A plurality of backing plates are provided to drive the punch elements against the workpiece when the backing plates are positioned in the operative position. A press-cutting pattern selector selectively positions the backing plates in the operative position or an inoperative position depending upon the pattern to be press-cut.

9 Claims, 8 Drawing Sheets

FIG. 14
| PUNCH / MOLD | $9_1$ | $9_2$ | $9_3$ | $9_{N-2}$ | $9_{N-1}$ | $9_N$ |
|---|---|---|---|---|---|---|
| $1A_M$ | × | | ○ | | × | |
| $1B_M$ | | × | | × | | ○ |
| $1A_{M-1}$ | × | | × | | ○ | |
| $1B_2$ | | ○ | | × | | × |
| $1A_1$ | ○ | | × | | × | |
| $1B_1$ | | × | | ○ | | × |
FIG. 15
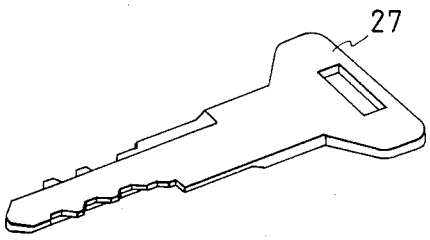
FIG. 16
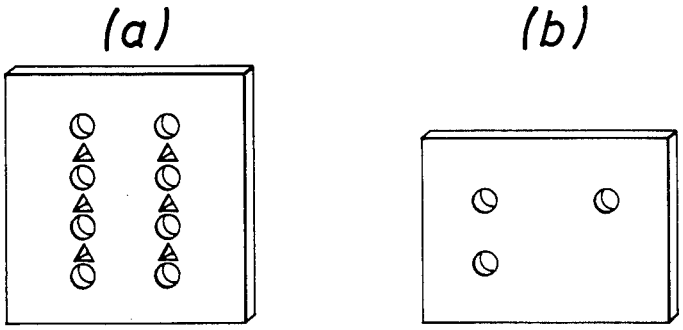

METHOD AND APPARATUS FOR PRESS-CUTTING VARIOUS PATTERNS

FIELD OF THE INVENTION

This invention relates to a method and an apparatus for press-cutting various patterns.

BACKGROUND OF THE INVENTION

Conventionally, press-cutting a number of different patterns requires a number of dies corresponding to the number of patterns. For example, when two kinds of punched hole patterns as shown in FIGS. 16(*a*) and (*b*) are formed, a separate die corresponding to each of the patterns is required. For this reason, the production of small lots of a particular pattern makes dies comparatively expensive and disadvantageous because of low productivity resulting from the cost of the dies and the lengthy time required for die rearrangements.

When keys having a versatile pattern (a combination of notches) as shown in FIG. 15 are made, either lot production by means of machining or item-by-item production using dies must be employed. In the case of the former, however, a key control system is required for storing and distributing keys in order to prevent the same kind of key from being made. In the case of the latter, many dies must be prepared and die costs skyrocket.

When a certain key is made on an item-by-item production basis, the machining quantity must be adjusted to that key in the case of lot production and the specification of the machine must be changed from use for lot production to item production. In the case of the latter, however, dies suitable for making the desired key must be selected from among alternatives. Moreover, item-by-item key production is not readily implemented.

OBJECTS AND SUMMARY OF THE INVENTION

In view of the foregoing, an object of the present invention is to provide a method and an apparatus for press-cutting various patterns without using dies corresponding to each of the patterns.

Another object of the present invention is to provide an economical method and apparatus for press-cutting various patterns where no particular key control system is required.

The manner by which the above objects and other objects features and advantages of the present invention are attained will become fully apparent from the following detailed description when it is considered in view of the drawings, wherein:

FIG. 14 is a diagram illustrating the function of a die;

FIG. 15 is a perpective view of a key that has been punched in accordance with the invention; and FIG. 16(*a*) and (*b*) are perspective views of other products produced by die punching.

DETAILED DESCRIPTON OF THE PREFERRED EMBODIMENTS

Figure 1:
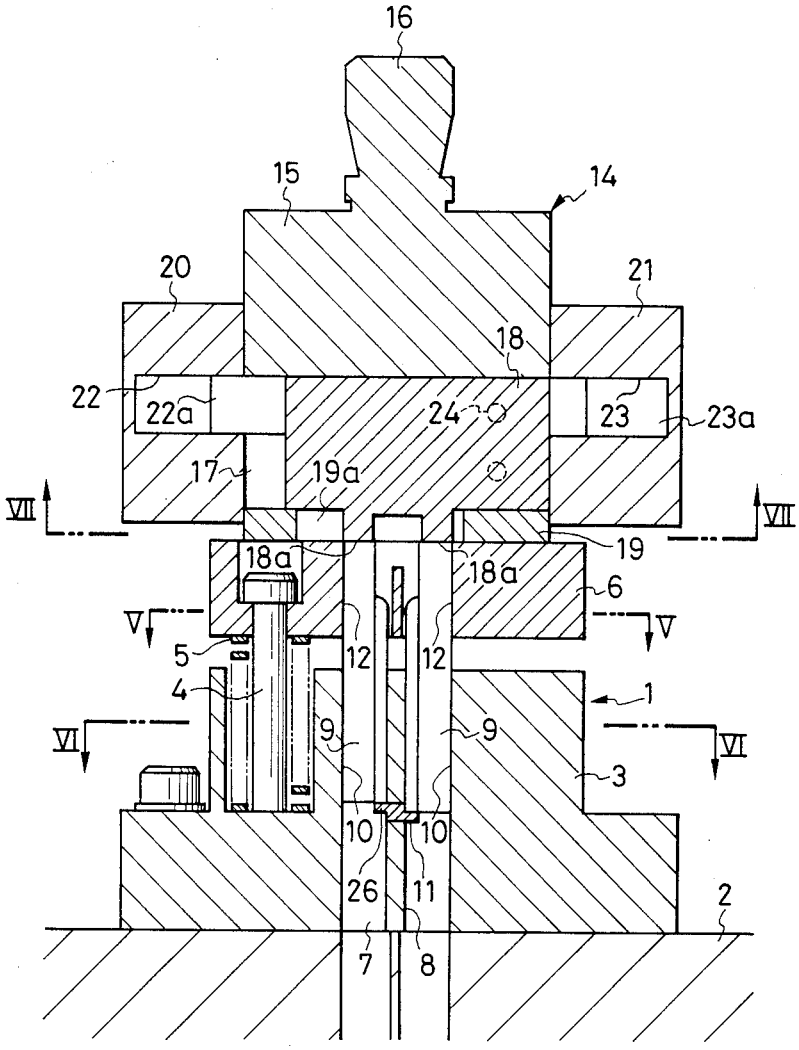
FIGS. 1, 2 and 3 are front part-sectional views of the press-cutting apparatus of the present invention illustrating the apparatus at different operational points.

Referring to FIGS. 1 through 12, first, the construction of a unit of the press-cutting apparatus of the present invention will be described. In FIG. 1, there is shown therein a die assembly 1 comprising a die 3 fixed onto a bolster 2 and a punch holder 6 normally held upward, i.e., in an inactive position by compression coil springs 5 that extend vertically from the die 3 with guide bolts 4 arranged on the die 3.

A rectangular hole 7 is formed in the lower half of the center portion of the die 3 and a key support 8 is formed in the center of the hole 7. A pair of holes 10 for receiving respective punches 9 are formed in the upper half of the center portion of the die 3. The holes 10 are roughly equal in cross section to the punches 9. A hole 11 for receiving a key as a workpiece is formed through the lower end portions of the holes 10 in the longitudinal direction.

In the punch holder 6, moreover, rectangular holes 12 corresponding to the holes 10 for receiving the punches 9 are formed in the center portion thereof and a recess 13 (FIG. 8) is formed in the center portion of the top face thereof. The punches 9 are inserted into the holes 12 of the punch holder 6 and the holes 10 of the die 3 from above and their heads are stopped at the recess 13, whereas their front ends are inserted into the hole 7 of the die 3.

Figure 2:
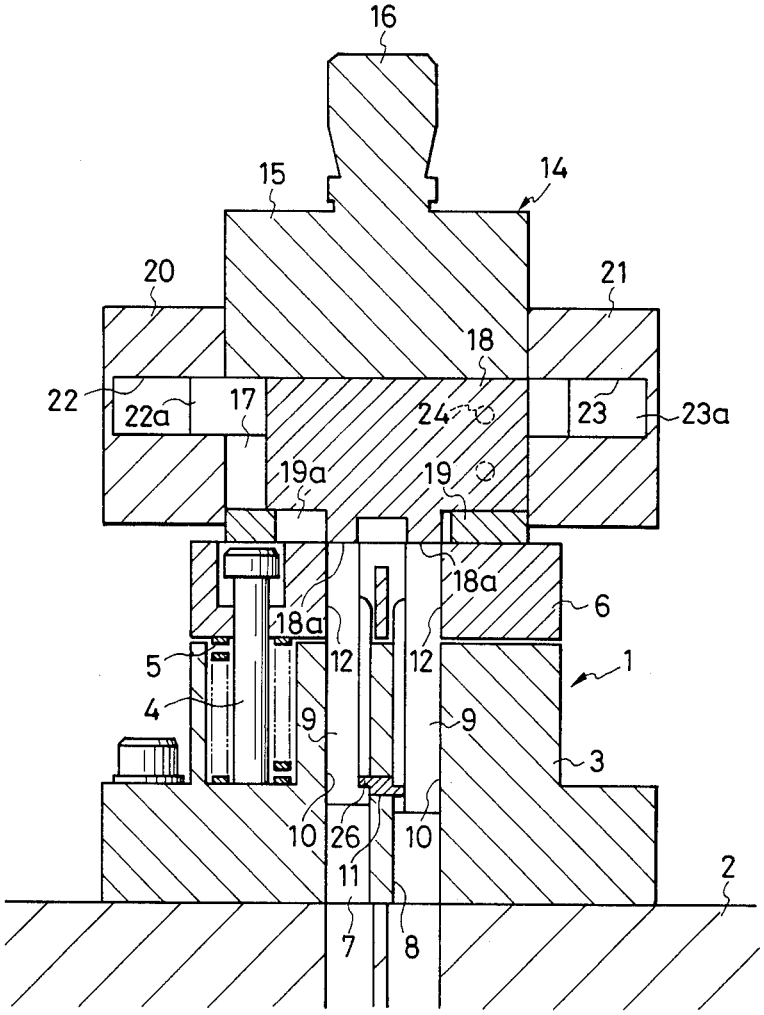
Figure 3:
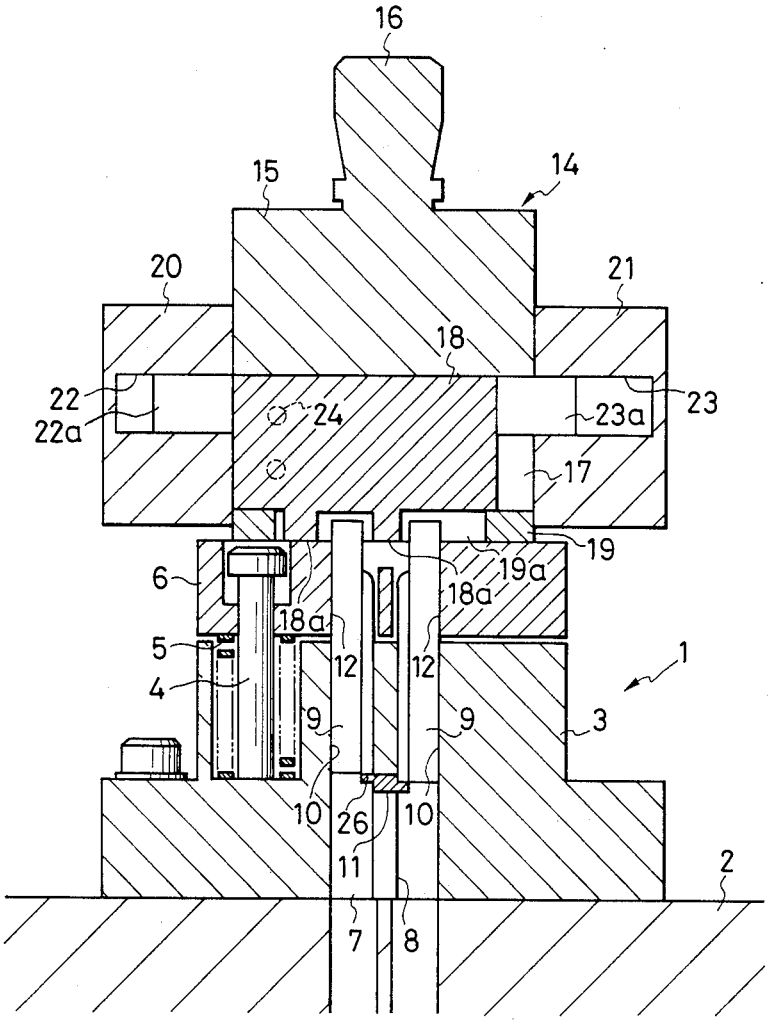
Figure 4:
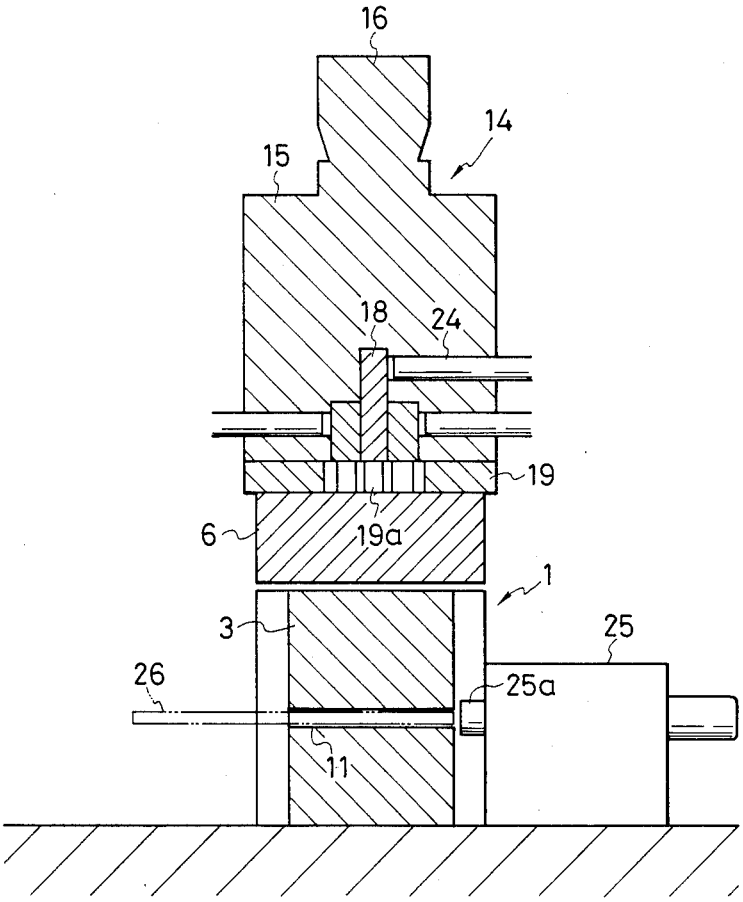
FIG. 4 is a side part-sectional side view of the apparatus of FIGS. 1–3.
Figure 5:
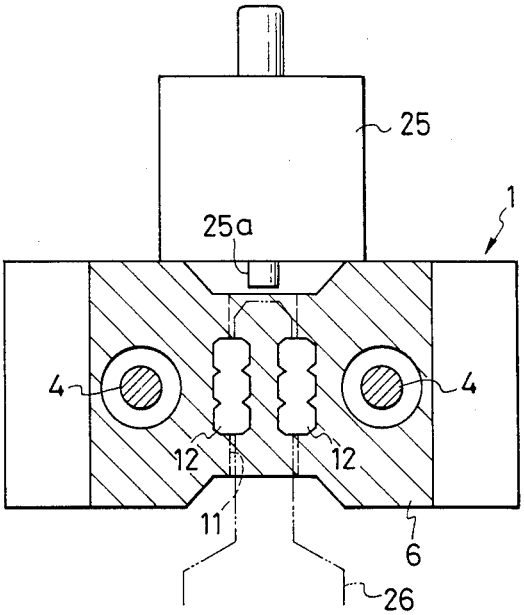
FIGS. 5 and 6 are sectional views taken along lines V—V and VI—VI of FIG. 1, respectively.
Figure 6:
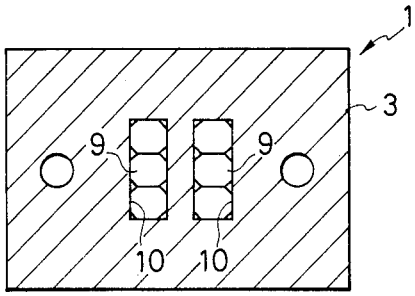
Figure 7:
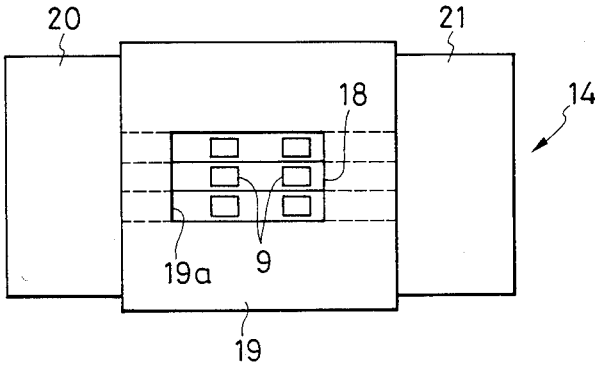
FIG. 7 is a sectional view taken along line VII—VII of FIG. 1.

A body 15 has a shank 16 coupled to the ram of a press (not shown) above the shank 16. A guide chamber 17 having open left and right sides is formed beneath the body 15. A plurality of backing plates 18 are movably accommodated in the guide chamber 17. The bottom sides of the backing plates 18 are supported by a support plate 19 installed in the under surface open portion of the body 15. Two press bosses 18*a* are formed on the bottom sides of the backing plates 18 and are respectively positioned in a rectangular hole 19*a* formed in the support plate 19. When the backing plates 18 are located in the right-hand operative position as shown in FIGS. 1 and 2, the press bosses 18*a* are aligned with the punches 9. When the press bosses 18*a* are located in the left-hand inoperative position, as shown in FIG. 3 they are not aligned with the punches 9.

Cylinder blocks 20, 21 for the selector body are installed respectively on the left-hand and right-hand sides of the body 15 so as to block the open left-hand and right-hand portions of the guide chamber 17. These cylinder blocks 20, 21 are respectively equipped with hollow cylinders 22, 23. Pistons 22*a*, 23*a* within the respective cylinders 22, 23, respectively, contact the left-hand and right-hand ends of the backing plates 18. The backing plates 18 in the guide chamber 17 are moved to an operative position when air is supplied to the cylinder 22 to move the piston 22*a* to the right, whereas the backing plates 18 are moved to an inoperative position when the air is supplied to the cylinder 23 to move the piston 23*a* to the left.

The body 15 is provided with a position detector unit comprising, e.g., a magnetic sensor, and the position detector unit is equipped with position detector members 24. In this case, the right-hand position detector member 24 is operated when the backing plates 18 are located in the operative position shown in FIGS. 1 and 2, whereas the left-hand position detector member 24 is operated when the backing plates 18 are located in the inoperative position shown in FIG. 3. Accordingly, whether or not the backing plates 18 are located in the operative position is detectable by means of position detecting signals from the position detector members 24. Numerals 25, 25*a* and 26 (FIG. 4) indicate a key insertion detector and a blank key as a workpiece, respectively.

Figure 12:
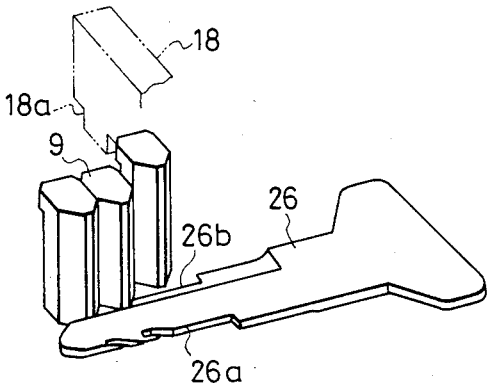
FIG. 12 is a perspective view showing the positional relation of a blank key to several punches in accordance with a preferred embodiment of the invention.

The operation of the selective processing unit 14 is controlled by computer (not shown) in that preset or operating patterns set by a keyboard (not shown) are stored in the computer. When the blank key 26 is inserted into the key hole 11 of the die 1 from its front opening 11*a* (FIG. 8) and when the detection bar 25*a* of a key insertion detector 25 (FIG. 5) is forced to move backward by the tip of the blank key 26, the insertion detector 25 generates a key detection signal and to indicate that the blank key 26 has been set in the proper press-cutting position. Accordingly, air is supplied to the cylinder of the cylinder block 20 or 21 based on the selection signal. When the selection signal is a "punch" signal air is supplied to the cylinder 22 based on the signal and, as shown in FIG. 1, the backing plates 18 are moved to the right-hand operative position by the piston 22*a* to cause the press bosses 18*a* to align with to the heads of the punches 9. When the backing plates 18 move to the operative position, the right-hand position detector member 24 detects the movement thereof and generates a position detecting signal. Upon receiving the position detecting signal, the computer confirms that the backing plates 18 have been located in the operation 1 position and gives an operating command signal to the press (not shown) to cause its ram to lower the selective processing unit 14. When the selective processing unit 14 is lowered, the punch holder 6 is forced lower as shown in FIG. 2 and the punches 9 are thereby pressed by the press bosses 18*a* of the backing plates 18. The blank key 26 is then punched by the punches 9 to selectively form notches in its crests 26*a*, 26*b* (FIG. 12).

If the selective signal from the computer is not a "punch" signal, air is supplied to the cylinder 23 and, as shown in FIG. 3, the backing plates 18 are moved by the piston 23*a* to the left-hand, inoperative position and, therefore, the press bosses 18*a* do not align with the heads of the punches 9. When the backing plates 18 are moved to the inoperative position, the left-hand position detector member 24 detects the movement and generates a position detecting signal. The computer confirms by the position detecting signal that the backing plates have been moved to the inoperative position and lowers the selective processing unit 14 in the same way as above mentioned. When the selected processing unit 14 is lowered, the punch holder 6 is thereby forced lower. As shown in FIG. 3, however, the punches 9 are not pressed by the press bosses 18*a* of the backing plates 18 and they do not punch the key 26 to form notches.

Figure 13:
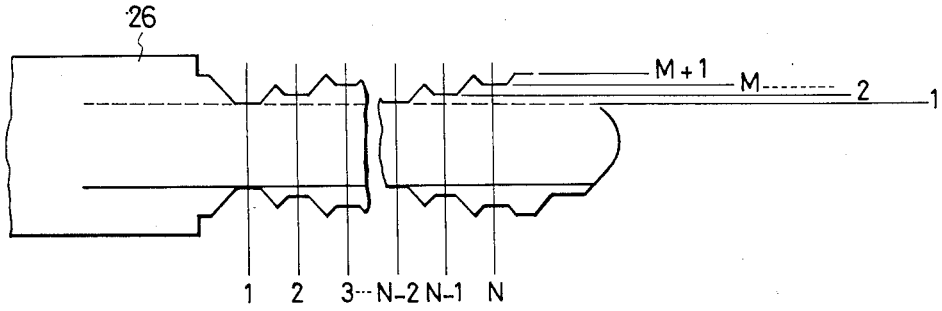
FIG. 13 is a partial top view showing the relation between the punching position number and the punching dimension number of a blank key.

The above description refers to the construction and function of an assembly 1 using dies. Referring to FIGS. 13 through 15, the following is a description of an embodiment of the present invention wherein a given number, e.g., 2M pieces of dies 1 are used. In other words, as shown in FIG. 13, N positions along the length of the key [1], [2], . . . [N] are set up for punching the blank key 26 to form notches in the crests 26*a*, 26*b* thereof and M kinds of notch dimensions [1], [2], [3], . . . [M] are provided, so that many kinds of keys may be formed by the combinations of punching position numbers [N] and punching dimension numbers [M]. The above 2M pieces of die assembly 1 are divided into a group A comprising M pieces of dies $1A_1$, $1A_2$, $1A_3$, . . . $1A_M$ corresponding to punches $9_1$, $9_3$, $9_5$, . . $9_{N-1}$, respectively, and set for punching the punching position numbers [1], [3], [5], . . . [N−1]; and group B comprising M pieces of dies $1B_1$, $1B_2$, $1B_3$, . . . $1B_M$ corresponding to punches $9_2$, $9_4$, $9_6$, . . . 9N, respectively, and set for punching the punching position numbers [2], [4], [6], . . . [N]. Moreover, the punches $9_1$, $9_3$, $9_5$, . . . $9_{N-1}$ and $9_2$, $9_4$, $9_6$, . . . $9_N$ of the dies $1A_1$, $1B_1$, respectively, have the punching dimensions marked with the punching dimension number [1], whereas the punches $9_1$, $9_3$, $9_5$, . . . $9_{N-1}$ and $9_2$, $9_4$, $9_6$, . . . $9_N$ of the dies $1A_2$, $1B_2$, respectively, have the punching dimensions marked with the punching dimension number [2], i.e., the numbers [1], [2], . . . [M] attached to the dies $1A_1$, $1B_1$, $1A_2$, $1B_2$, . . . , $1_M$, $1B_M$ means that the punching dimension of each punch corresponds to the punching dimension number [1], [2], . . . [M]. The reason for the division of the die assembly 1 into the group A of $1A_1$, $1A_2$, . . . $1A_M$ and the group B of $1B_1$, $1B_2$, . . . $1B_M$ is that, in view of dimensional relationship, N pieces of punches cannot be arranged on a straight line so as to make them correspond to the punching position numbers [1], [2], [3], . . . [N] in a piece of die 1 on a 1-to-1 basis. Accordingly, the die assembly is divided into the A and B groups alternately corresponding to the punching position numbers [1], [2], [3], . . . [N] so that the punches can be arranged on a straight line. In consequence, a piece of blank key 26 is mounted on the 2M pieces of dies $1A_1$, $1B_1$, $1A_2$, $1B_2$, . . . $1A_M$, $1B_M$ and successively punched.

FIG. 14 is a Table showing the operative and inoperative conditions of the punch in each die for punching the crests 26*a*, 26*b* of the blank key 26, wherein [O] and [X] respectively represent operative and inoperative conditions. In the case of the die $1A_M$ having punches $9_1$, $9_3$, $9_5$, . . . $9_{N-1}$ of the punching dimension [M], at least the punch $9_3$ is selectively operated so as to form notches in conformity with the punching dimension of [M] in the punching place [3] of the crests 26*a*, 26*b*. In the case of the die $1B_M$ having punches $9_2$, $9_4$, $9_6$, . . . $9_N$ of the punching dimension [M], at least the punch $9_N$ is selectively operated so as to form notches in conformity with the punching dimension of [M] in the punching place [N] of the crests 26*a*, 26*b*. In the case of the die $1A_{M-1}$ having punchings $9_1$, $9_3$, $9_5$, . . . $9_{N-1}$ of the punching dimension [M−1], at least the punch $9_{n-1}$ is selectively operated so as to form notches in conformity with the punching dimension of [M−1] in the punching place [N−1] of the crests 26*a*, 26*b*. In the case of the die $1B_2$ having punches $9_2$, $9_4$, $9_6$, . . . $9_N$ of the punching dimension [2], at least the punch $9_2$ is selectively operated so as to form notches in conformity with the punching dimension of [2] in the punching place [2] of the crests 26*a*, 26*b*. In the case of the die $1A_1$ having punches $9_1$, $9_3$, $9_5$, . . $9_{N-1}$ of the punching dimension [1], at least the punch $9_1$ is selectively operated so as to form notches in conformity with the punching dimension of [1] in the punching place [1] of the crests 26*a*, 26*b*. Finally, in the case of the die $1B_1$ having punches $9_2, 9_4, 9_6, \ldots 9_N$ of the punching dimension [1], at least the punch $9_{N-2}$ is selectively operated so as to form notches in conformity with the punching dimension of [1] in the punching place [N−2] of the crests 26*a*, 26*b*.

A key 27 shown in FIG. 15 has been manufactured based on the above process. As set forth above, the selective action of the punch is provided by the selective processing unit 14 controlled by the computer, but the selective processing unit 14 may be arranged for every 2M dies or one selective processing unit 14 may be moved so as to successively correspond to each die or furthermore 2M dies may successively be moved to correspond to one selective processing unit 14.

Figure 8:
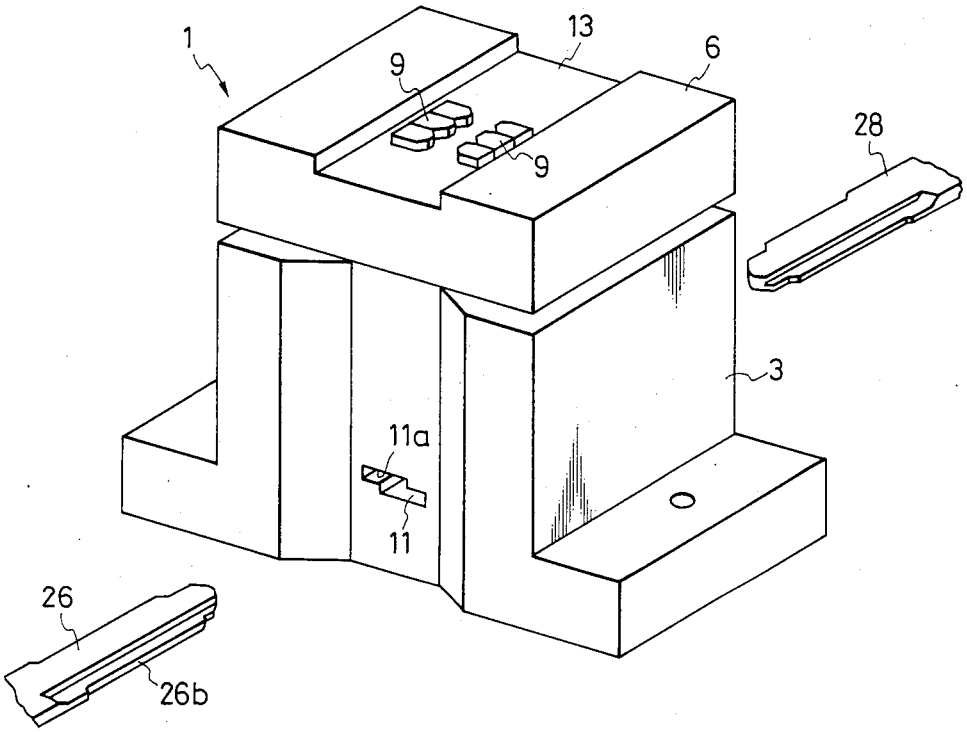
FIG. 8 is a perspective view of a die constructed in accordance with a preferred embodiment of the invention.
Figure 9:
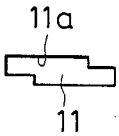
FIGS. 9 and 10 are front and rear views, respectively, of the key hole for receiving keys shown in FIG. 8.
Figure 10:
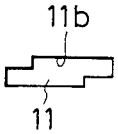
Figure 11:
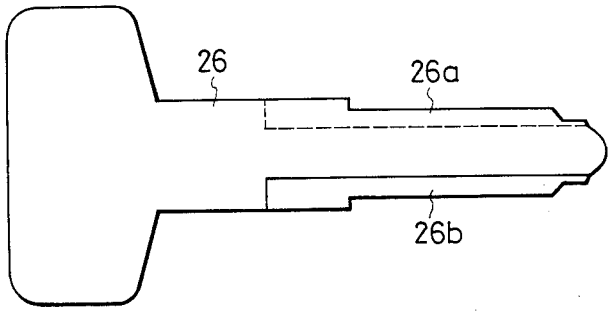
FIG. 11 is a top view of a blank key.

As shown in FIGS. 9 and 10, the front and rear openings 11*a*, 11*b* of the hole 11 of the die assembly 1 for receiving a key are linearly symmetrical and it is therefore obviously impossible to insert the blank key 26 into the hole 11 for receiving the key from the rear opening 11*b*. Accordingly, a blank key 28 that can be inserted into the hole 11 from the rear opening 11*b* is, as shown in FIG. 8, linearly symmetrical with the blank key 26. Thus, a key 28 which is different from the key 26 can be processed by installing the die assembly 1 inversely centering around the bolster 2, inserting the blank key 28 into the hole 11 from the opening 11*b* and punching in to form the same pattern as that of the blank key 26.

The following effects can be obtained from the present embodiment: Two groups A, B of M pieces of dies, i.e., 2M pieces of dies $1A_1, 1A_2, \ldots 1A_M$ and $1B_1, 1B_2, \ldots 1B_M$ in total, are provided depending on the punching places and dimensions of the blank key 26 and the punches $9_1, 9_3, 9_5, \ldots 9_{N-1}$ and $9_2, 9_4, 9_6, \ldots 9_N$ respectively installed therein are selectively operated so as to perform punching operations. Consequently, many kinds of keys can be produced using 2M+1 pieces of dies. Since many kinds of keys can be manufactured at random, a key control system is not required as in the case of conventional lot production. Because it is different than an item production system, the method of processing many patterns according to the present invention can drastically reduce die costs because it is unnecessary to prepare various kinds of dies.

The punching dimension number [M+1] of FIG.13 refers to punching no notch and use can be made of a die for punching the blank key 26 to form a shoulder. In consequence, the number of dies required becomes the punching dimension number M×the number of groups
2+1=2M+1. As any desired operating pattern can selectively be stored by operating the keyboard of the computer, a blank key can be punched to form a given notch according to the operating pattern, whereby any item of key can be readily manufactured. Because the hole 11 for receiving a key is cut through the longitudinal direction of the die assembly 1, the front and rear openings 11*a*, 11*b* of the hole 11 are linearly symmetrical. Accordingly, the blank key 26 insertable from the opening 11*a* and the blank key 28 insertable from the opening 11*b* are linearly symmetrical and, by inversely installing the die assembly 1 centering around the bolster 2, more dissimilar keys can be manufactured, i.e., many different kinds of keys can be manufactured only by using 2M+1 dies. The combination of the die assembly 1 having the punches $9_1, 9_3, 9_5, \ldots 9_{N-1}$ ($9_2, 9_4, 9_6, \ldots 9_N$) and the selective processing unit 14 having the backing plates 18 for selectively operating the punches $9_1, 9_3, 9_5, \ldots 9_{n-1}$ ($9_2, 9_4, 9_6, \ldots 9_N$) makes it possible to punch and form the patterns set on the blank keys 26, 28, so that an apparatus for the purpose can be made simple and rationalized in construction.

Although a description has been given of the embodiment wherein N punching positions and M different punching dimensions are provided, the concrete number and kinds of them may be variously selected and, in that case, the plurality of dies are divided into a given number of groups A, B, . . . . Moreover, although the present invention has been applied to the above-described manufacture of keys, it is also applicable to the manufacture of punched patterns as shown in FIGS. 16(*a*) and (*b*).

As evident from the above description, since a plurality of punches installed in a die assembly are selectively operated, products having various patterns can be manufactured using the same die assembly. This contributes to improvements in productivity and cost reduction. In the manufacture of products having a wide assortment of patterns, e.g., keys, a given number of groups of dies are provided which have holes for receiving punches corresponding to a plurality of notches to be cut in a workpiece. The plurality of punches are inserted in the holes of each die of each group and preferably the punches have the same punching dimension regarding the same die and different dimensions relative to the other dies. The workpiece is mounted on the dies and the punches of the dies are selectively operated. In consequence, no key control system is required and die cost is drastically reduced.

The punching method of the present invention by which items such as keys are readily manufactured is also usable for processing various kinds of patterns.

The punching apparatus according to the present invention comprises a given number of dies divided into a given number of groups in such a manner as to have holes for receiving punches corresponding to a plurality of punching places of a workpiece, each die being equipped with a plurality of punches having the same punching dimension and different punching dimensions relative to the other dies. A selective processing unit has a plurality of backing plates corresponding in position to the dies and made movable to and form an operative position corresponding to each punch and an inoperative position without corresponding to each punch. The selective processing unit is used to punch the workpiece fitted into the holes for receiving the workpiece in the dies by operating the punches corresponding to the backing plate in the operative position. A selector body selectively moves the backing plate to the operative position on the basis of a predetermined selection signal. The selector body is installed in the selective processing unit.

In addition, the embodiments of the present invention are not limited to what have been described and illustrated above. As a selector body for operating backing plates, not only cylinders but also other driving means, e.g., solenoids, may be used and various changes and modifications may be made in the invention without departing from the spirit and scope of the following claims.

What is claimed is:

1. An apparatus for press-cutting patterns at selected ones of a total number of consecutive positions on a single workpiece, comprising:

a plurality of dies each defining a predetermined dimension at predetermined ones of the total number of positions on said workpiece, said plurality of dies being grouped into at least two groups for press-cutting the single workpiece, each group defining different ones of said consecutive positions, each die within said group of dies defining the same predetermined positions as other dies within said group and a different predetermined dimension from said other dies within said group;

a plurality of punches associated with each die for punching said workpiece at selected ones of the predetermined positions defined by each die with a selected pattern having a dimension corresponding to the dimension defined by the corresonding die;

a backing plate for each of said punches of each die, each said backing plate being positionable into an operative position for striking said associated punch and an inoperative position to prevent striking of said associated punch; and means for selectively positioning each said backing plate into one of said operative position and inoperative position.

2. An apparatus according to claim 1, wherein each of said backing plates includes means for indicating whether said backing plate is in said operative position or said inoperative position.

3. An apparatus according to claim 1, wherein said positioning means comprises a plurality of cylinders, each of said cylinders being associated with a different one of said backing plates and including a piston for moving said associated backing plate between said operative position and said inoperative position.

4. An apparatus according to claim 1, further including a punch holder for supporting said punches in said corresponding dies.

5. An apparatus according to claim 1, further including a workpiece detector for indicating the presence of a workpiece on said workpiece holder.

6. An apparatus according to claim 1, wherein each of said backing plates includes a press boss adapted to strike an end of said punch associated with said backing plate during press-cutting when said backing plate is in said operative position.

7. The apparatus of claim 1, wherein the predetermined positions of each die of each group correspond to non-consecutive positions on the workpiece.

8. The apparatus of claim 7, wherein the non-consecutive positions are alternate positions.

9. A method for press-cutting patterns at selected ones of a total number of consecutive positions on a single workpiece, comprising the steps of:

providing a plurality of dies each defining a predetermined dimension at predetermined ones of the total number of positions on said workpiece, said plurality of dies being grouped into at least two groups for press-cutting the single workpiece, each group defining different ones of said consecutive positions, each die within said group of dies defining the same predetermined positions as other dies within said group and a different predetermined dimension from said other dies within said group;

providing a plurality of punches associated with each die for punching said workpiece at selected ones of the predetermined positions defined by each die with a selected pattern having a dimension corresponding to the dimension defined by the corresponding die;

providing a backing plate for each of said punches of each die, each said backing plate being positionable into an operative position for striking said associated punch and an inoperative position to prevent striking of said associated punch; and providing means for selectively positioning each said backing plate into one of said operative position and inoperative position.

* * * * *